United States Patent [19]

Frye et al.

[11] 4,274,319

[45] Jun. 23, 1981

[54] SLITTER FOR HIGH BULK TRAVELING PAPER WEB MATERIAL

[75] Inventors: Kenneth G. Frye, Lee, Mass.; Donald C. Fitzpatrick, Chatham, N.Y.

[73] Assignee: Lenox Machine Company, Inc., Lenox, Mass.

[21] Appl. No.: 29,398

[22] Filed: Apr. 12, 1979

Related U.S. Application Data

[63] Continuation-in-part of Ser. No. 810,575, Jun. 27, 1977, Pat. No. 4,157,672.

[51] Int. Cl.[3] ..... B26D 1/24

[52] U.S. Cl. ..... 83/430; 83/496; 83/500

[58] Field of Search ..... 83/496, 497, 500, 501, 83/502, 430, 503

[56] References Cited

U.S. PATENT DOCUMENTS

| | | | |
|---|---|---|---|
| 164,920 | 6/1875 | Judson | 83/497 |
| 559,179 | 4/1896 | Koegel | 83/497 |
| 1,315,340 | 9/1919 | Scully | 83/430 |
| 2,554,027 | 5/1951 | Haswell | 83/497 X |
| 3,186,282 | 6/1965 | Waterhouse | 83/497 |
| 3,459,086 | 8/1969 | Reeder, Jr. | 83/496 X |
| 3,651,728 | 3/1972 | Young | 83/503 X |
| 3,682,032 | 8/1972 | Pfeiffer | 83/496 |

FOREIGN PATENT DOCUMENTS

| | | | |
|---|---|---|---|
| 2151621 | 4/1973 | Fed. Rep. of Germany | 83/496 |
| 15332 | of 1908 | United Kingdom | 83/496 |
| 429900 | 10/1974 | U.S.S.R. | 83/496 |

*Primary Examiner*—Frank T. Yost

*Attorney, Agent, or Firm*—Hill, Van Santen, Steadman, Chiara & Simpson

[57] ABSTRACT

Cooperating slitter blades in a slitter for high bulk traveling paper web material attain high cut point pressure and minimum slit plowing and dusting as a result of critical cooperation of the slitting edges of the blades wherein one of blade edges rotates in a plane parallel to the longitudinal axis of travel of the web, and the slitting edge of the other of the blades cooperates to a penetration or overlap extent of less than 0.030 inch at a rake angle of 0 to 10 minutes and a toe-in of 5 to 30 minutes. Where the other blade edge is of high angle type an included angle between opposite faces of the edge of 15 to 30 degrees is provided and where a low angle edge is preferred, the included angle between opposite faces of the blade is between 75 and 85 degrees.

11 Claims, 9 Drawing Figures

SLITTER FOR HIGH BULK TRAVELING PAPER WEB MATERIAL

This application is a continuation-in-part of the application of Kenneth G. Frye, Ser. No. 810,575 filed June 27, 1977, now U.S. Pat. No. 4,157,672 issued June 12, 1980.

The present invention relates to slitters for high bulk traveling paper web material and is more particularly concerned with slitters of the type adapted to be located between a web source and a sheeter or winder, for slitting the web longitudinally at high speed.

The theory of shearing web material is to create as high a unit load on the surface of the material as possible at the cut point in order to penetrate and sever the individual fibers of the paper web. Any action which occurs at the point of shearing that does not precisely cut the fibers but instead results in a tearing of the fibers will result in a poorer, less precise edge and will result in the generation of dust which can become very undesirable at all speeds. The dust problem is aggravated where there is any substantial amount of plowing, that is where due to depth of penetration and bevel of the blades, the web must deviate at the cut point. Because this deviation occurs in a very short distance, the web is strained to a point of rupture and has been observed actually to rupture ahead of the cut point.

In high speed paper web cutting, the problem of dust is a serious one and creates limiting parameters of operation and thickness of bulk being cut. As to the thickness in which multiple sheets can be cut, this is limited by the quality of cut produced in the intermediate sheets, and as the number of multiple sheets is increased, a point will be reached wherein the quality of cut becomes unsatisfactory for commercial grade sheets. Various factors, of course, influence the dust created such as the furnish used, i.e., the amount of distribution of fines, the compressibility factor of the sheets, the total thickness, the coating used, etc. The generation of dust also can make it necessary for frequent shut-downs for replacement or sharpening of the knives thereby reducing the overall output of a commercial machine and increasing the cost of operation. Slit quality and dust are primary factors, and these have been found to be affected by sheet flutter, incorrect penetration of the cutter, improper loading, incorrect shear angle, slitter vibration, machine vibration, excessive wear, as speeds increase as well as thickness and bulk of the web increase.

We have discovered that quality of slit can be substantially improved and the amount of dust generation substantially minimized by certain critical blade cutting edge relative adjustments at the cutting point.

It is accordingly an object of the present invention to provide an improved slitter which is capable of cutting traveling high bulk paper webs with an improved quality of cut edge and substantial reduction in dust generation during slitting.

In an embodiment of the invention, a slitter for high bulk traveling paper web material and adapted to be located between a web source and subsequent processing equipment, comprises means for guiding the traveling web along a longitudinal axis of movement, first and second rotary slitter blades having peripheral slitting edges cooperating at a web slitting cut point, the first blade having its axis of rotation transverse to the longitudinal axis of movement of the web and having its slitting edge rotational in a plane which is parallel to said longitudinal axis of movement of the web, the blades having their slitting edges at less than 0.030 inch overlap, the second blade having its slitting edge at a rake angle of 0–10 minutes relative to the slitting edge of the first blade at the cut point, and the second blade slitting edge being at a toe-in angle of 5 to 30 minutes relative to the first blade slitting edge at the cut point.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 6:
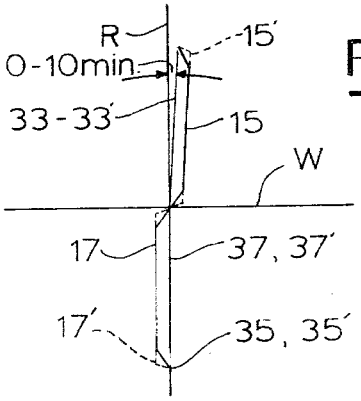

FIG. 6 schematically represents the rake angle of the slitting blades.

Figure 7:
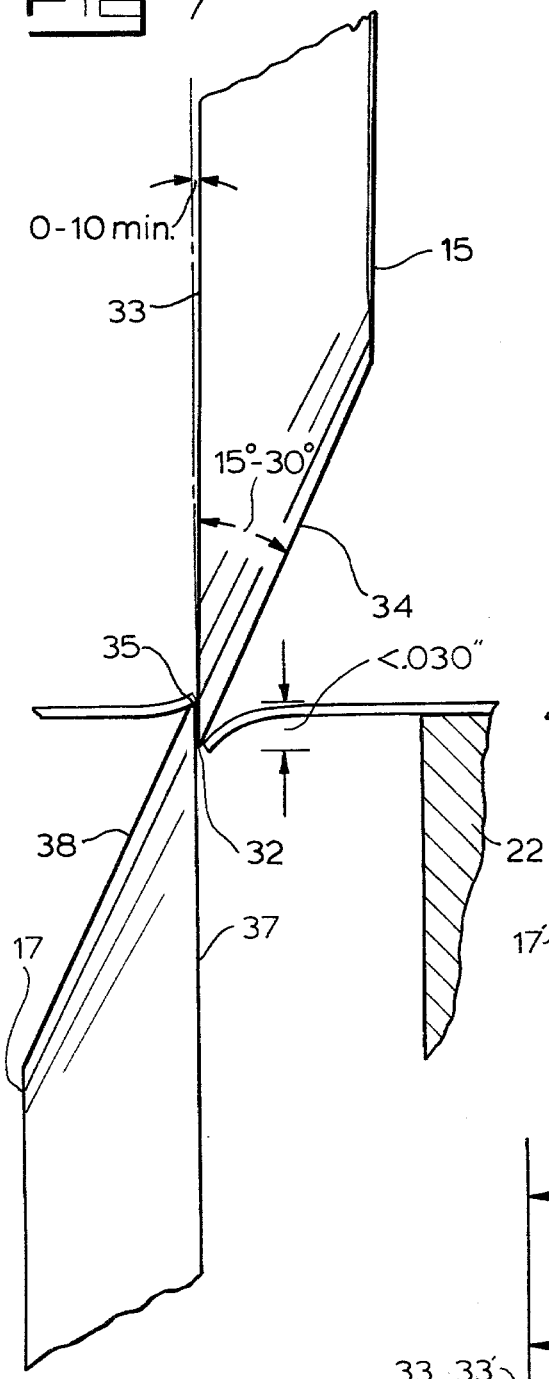

FIG. 7 is a substantially enlarged fragmentary sectional elevational view taken through the cut point of the high angle blades.

Figure 8:
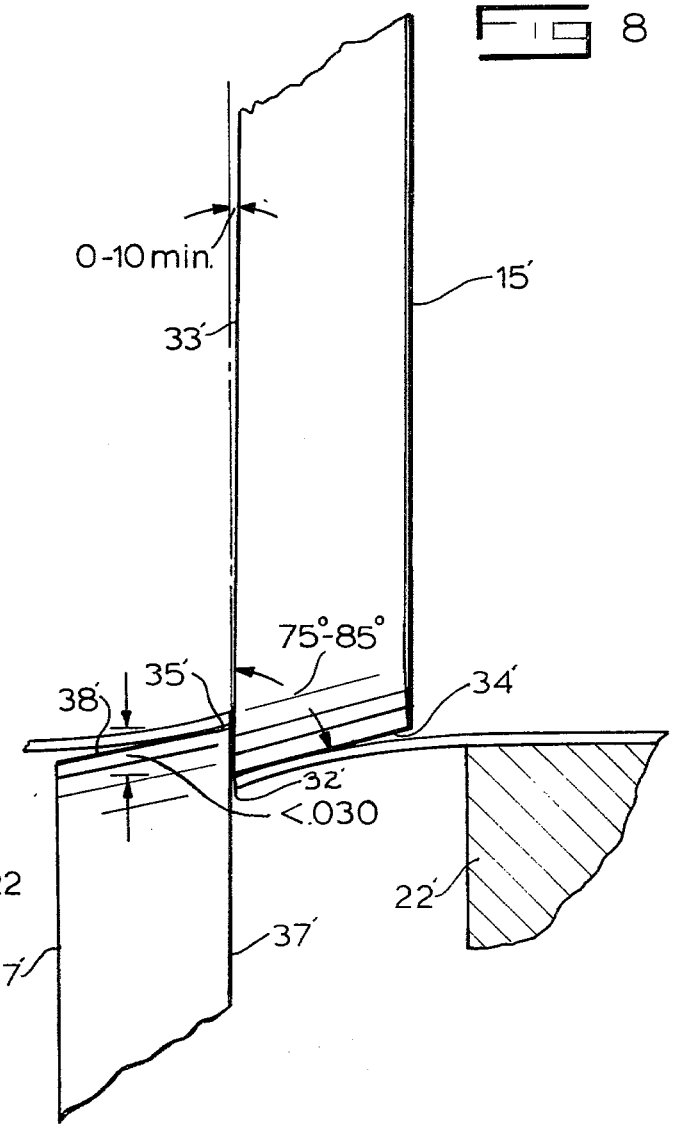

FIG. 8 is a view similar to FIG. 7, but depicting the cut angle of the low angle slitter blades.

Figure 9:
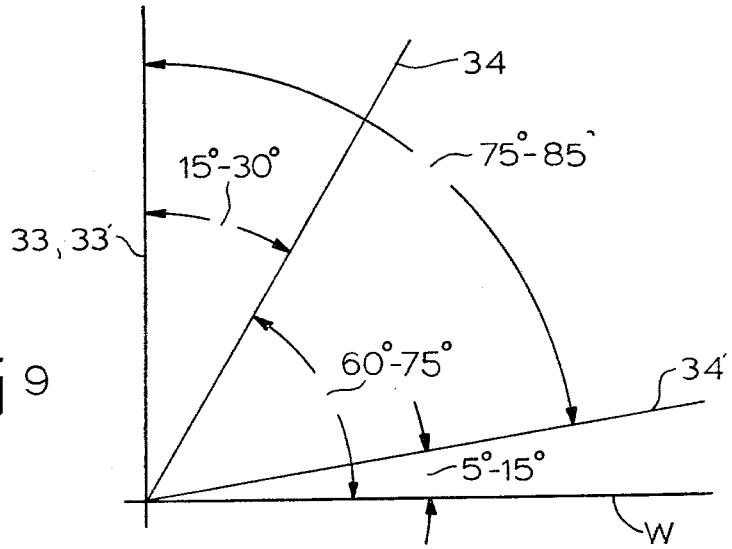

FIG. 9 is a graphic illustration of critical blade edge angles.

Figure 1:
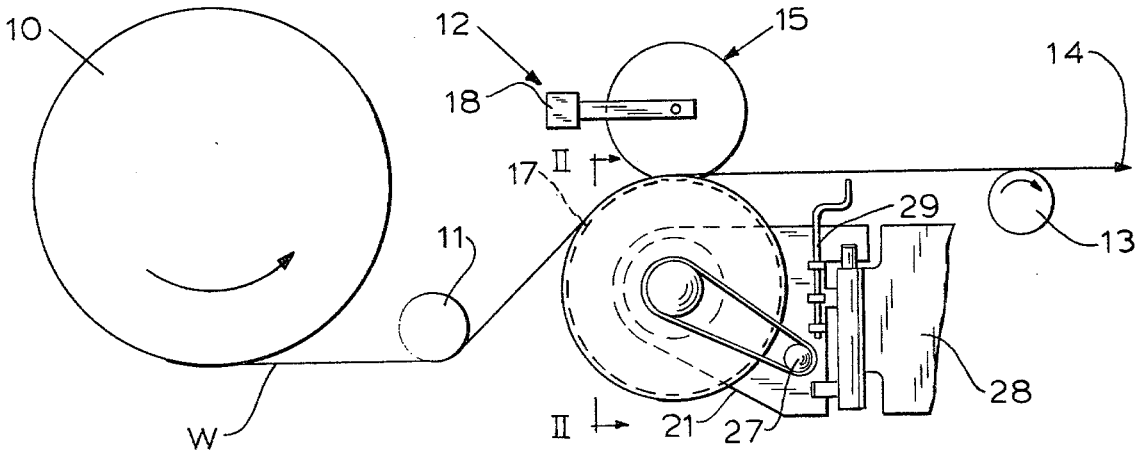
FIG. 1 is a more or less schematic side elevational view depicting a representative slitter embodying principles of the present invention.

Referring to FIG. 1, a web W is adapted to be unwound from a roll 10 which is suitably supported on a hub and bearings, not shown. Means for guiding the traveling web along a longitudinal axis of movement comprises a guide roll 11 under which the web W passes to a slitting station 12 where one or more longitudinal slits are formed parallel to the web axis. The slit strips of the web are then guided from the slitting station 12 by means such as a roll 13 which may spread the strips to prevent their interfering at their edges and from which the strips pass through other processing equipment such as winders, sheeters, printing presses, supercalendars, or the like, generally indicated by the arrow 14. Slitting is effected in the slitting station 12 by means of cooperating first and second rotary slitter blades 15 and 17, respectively. In this instance, the slitter blades 15 are upper and the slitter blades 17 are lower. Any suitable supporting means 18 may be provided for operatively rotatably orienting the blades 15 in their desired slitting orientation with respect to the lower slitter blades 17.

In the illustrated example (FIGS. 1 and 2), a plurality of the slitter blades 15 cooperate with a plurality of the slitter blades 17 to slit the web W into a plurality of strips. Whereas each of the upper slitter blades 15 may be individually supported by the support means 18, the lower slitter blades 17 are preferably supported in relatively adjustable relation on a rotary slitter drum assembly 19 which may be a single shaft unit, but which is shown as comprising a pair of units 20 coaxially aligned in end-to-end relation under the web W. Where a narrow web is to be slit, only one of the units 20 may suffice. Where wide webs are to be handled, multiple units are preferred because the web support bearing arrangement at spaced locations is better for slit quality, and individual drums can be moved easily for proper cross machine placement. In a preferred bearing arrangement, each of the units 20 comprises a separate supporting bracket structure 21 which desirably mounts a pair of axially spaced web-supporting drums 22 on rotary bearing means 23, the drums 22 being adapted to be rotatably driven as by means of endless flexible transmission elements 24 such as belts trained over driven pulleys 25 and also over driving pulleys 27 and suitably driven at desired speed in any preferred manner. The supporting brackets 21 are preferably mounted on a support frame 28 in a manner to permit lateral adjustment in order to effect changes in the lateral location of the slits in the web W, and for this purpose adjustment means including hand-crank structure 29 may be provided. Each of the drums 22 may carry one of the slitter blades 17 sandwiched between a pair of spacers 30 of smaller diameter than the blade in each instance. For stability in supporting the web W annular plates 31 of the same diameter as the drums 22 are mounted at the outer ends of the slitter blade and spacer assembly in each instance and may serve as part of a clamping structure for clamping the blade and spacer assembly to the drum.

Figure 2:
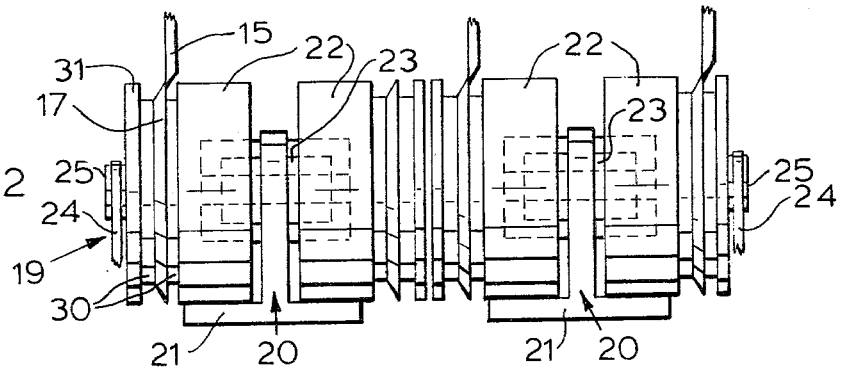
FIG. 2 is a fragmentary elevational view taken substantially in the plane of line II—II of FIG. 1.
Figure 3:
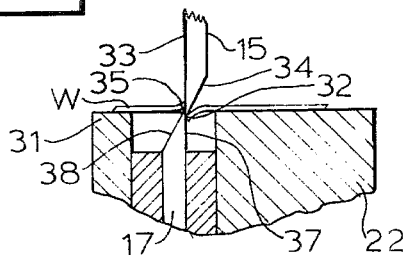
FIG. 3 is an enlarged fragmentary vertical sectional view taken through the cut point of, for example, the left-hand high angle slitting blades shown in FIG. 2.

As shown in FIGS. 2 and 3, the slitter blades 15 and 17 are of the high angle edge type, that is the blades 15 have respective peripheral slitting edges 32 at the convergence of a plane side surface 33 and an opposite side steep bevel surface 34. Similarly, the slitter blades 17 have respective peripheral slitting edges 35 at convergence of a plane surface 37 at one side and a steep bevel surface 38 at the other side. In the cooperative relation, the plane surfaces 33 and 37 of the cooperating slitter blades 15 and 17 face toward one another or at least toward the projected planes of the respective faces.

Figure 4:
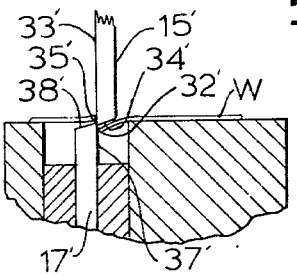
FIG. 4 is a fragmentary vertical sectional view similar to FIG. 3, but showing adaptation of the invention to low angle slitting blades.

Instead of high angle blades, the blades may be of the low angle type as shown in FIG. 4 and identified as 15' and 17', having respectively cutting edges 32' and 35', plane facing surfaces 33' and 37' at one side and low angle bevel surfaces 34' and 38' at the opposite sides converging toward the edges 32' and 35', respectively.

Toward the attainment of maximum cut quality, certain critical relationships between the cooperating slitter blades have been found necessary. Whether the blades are of the high angle or the low angle type, depth of penetration of the cooperating blades, rake angle and toe-in must be critically related. For best results, the bevel or blade edge angles of the cooperating slitter blades should be maintained within certain limits in both the high angle and the low angle blades.

For slitting high bulk traveling paper web material such as the web W, whether presented for slitting in a single ply as shown by way of illustration or in multiple plies, remarkable and surprising improvement in cut quality is obtained by limiting the depth of penetration of the slitter edges into the paper web at the slitting point to a depth of less than 0.030 inch, with a preferred penetration depth of about 0.015 inch. Depth of penetration is best measured by the amount of overlap of the blade edges, as best visualized in FIGS. 7 and 8 where on a substantially enlarged scale such depth of penetration overlap is depicted for both the high angle blades 15 and 17 of FIG. 7 and the low angle blades 15' and 17' of FIG. 8. In contrast, standard in the industry has been 0.060 inch which has heretofore been considered the practical minimum limit of penetration.

To obtain the advantages of minimum penetration, attention must be paid to provide a properly adjusted rake angle. As best visualized in FIGS. 5 and 6, the blade 17 or 17', as the case may be, is mounted with its rotary plane substantially parallel not only to the axis of movement of the web, represented by the arrow WA (FIG. 5), but also substantially perpendicular to the plane of the web W (FIG. 6). In FIG. 6, the plane of rotation represented by the vertical line R of the blades 17, 17' is shown as aligned with the edge 35, 35' of the slitter blade 17, 17' and at the face 37, 37'. A rake angle of from 0 to 10 minutes of the blade 15, 15' relative to the blade 17, 17' is represented in FIGS. 6, 7 and 8 having regard to the plane of revolution line R and the face 33, 33' of the blade 15, 15'.

Figure 5:
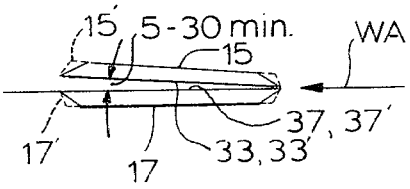
FIG. 5 is a schematic illustration depicting the toe-in of the slitter blades.

In critical relation to the depth of penetration and rake angle, the toe-in angle must be carefully adjusted to be within a range of 5 to 30 minutes, with a preferred adjustment to 15 minutes, represented in FIG. 5 between the blade faces 33, 33' of the blade 15, 15' and the surface 37, 37' of the blade 17, 17'.

The critical rake and toe-in angles, taken together minimize rubbing contact between the blades after they pass the cut point but are still in the overlap area. This reduces blade wear.

As a result of the combination of critical relationships in depth of penetration, rake angle and toe-in, rubbing wear of the blades after the cut point in the overlap area is avoided and excellent slitting pressure is attained at the cut point of the cooperating blades, but plowing is greatly minimized, and climbing of the blades one upon the other is avoided as they rotate in the slitting process.

Further improvement in slitting cooperation of the slitter blades is attained where, in addition to the critical relationships as to blade penetration, rake and toe-in, the bevel angles of the blades toward the cutting or slitting edges is maintained within particular ranges, having regard to both the high angle blades 15 and 17 and the low angle blades 15' and 17'. Best results are obtained with the high angle blades 15 and 17 where the bevel angle between the surface 33 (i.e. the rotary edge plane) and the surface 34 (i.e. the bevel plane) of the blade 15 and the bevel angle between the surface 37 (i.e. the rotary edge plane) and the surface 38 (i.e. the bevel plane) of the blade 17 is from 15 to 30 degrees. With respect to the low angle blades 15' and 17', superior results are attained where the bevel angle between the surfaces 33' (i.e. the rotary edge plane) and the surface 34' (i.e. the bevel plane) of the blade 15' and the angle between the surfaces 37' (i.e. the rotary edge plane) and the surface 38' (i.e. the bevel plane) of the blade 17' is between 75° and 85°. In both instances, the result is high cut point pressure for excellent slitting, realizing simple deflection of the cut edge, as represented in FIGS. 7 and 8, with so little spreading of the cut edges of the web as to greatly minimize plowing action.

On reference to FIG. 9, a graphic representation of the various angular relationships is presented showing not only the angle range of 15° to 30° between the high angle blade surfaces 33 and 34 and the angle range of 75° to 85° between the blade surfaces 33' and 34', but also the corresponding angle range of about 60 to 75 degrees between the blade surface 34 and the plane of the web W (i.e. the plane which extends through the cutting edge 32 normal to the rotational plane of the edge represented by the surface 33) and the angle range of from about 5° to 15° between the blade surface 34' and the plane of the web W (i.e. the plane which extends through the cutting edge 32' normal to the rotational plane of the edge represented by the surface 33'). It is noted that at a blade edge angle of greater than 30° between the blade edges 33 and 34, or a blade angle of less than 75° between the surfaces 33' and 34' in the low angle blade will tend to cause plowing. Further, a blade angle greater than 85° between the surfaces 33' and 34' will result in insufficient unit pressure at the cut point. Within the fairly critical angle ranges for respectively the high angle blades and the low angle blades referred to, the desired sharp blade angle on both cooperating blades and resultant high unit pressure at the cut point are attained. Stated another way, the particular angle ranges provided in the bevels 34 and 38 of the blades 15 and 17, respectively, and the angle ranges provided in the bevels 34' and 38' of the blades 15' and 17', respectively, assure sharp cutting edges affording the desired high unit pressure at the cut point. It will be understood, of course, that the blade bevel angles or relief on both of the blades 15 and 17 in the high angle blade combination should be the same. Similarly, in the low angle blade combination 15', 17' the blade bevel angle or relief should be the same for each blade.

It will be understood that variations and modifications may be effected without departing from the spirit and scope of the novel concepts of this invention.

We claim:

1. A slitter for high bulk traveling paper web material and adapted to be located between a web source and subsequent processing equipment comprising:

means for guiding the traveling web along a longitudinal axis of movement;

first and second rotary slitter blades having peripheral slitting edges cooperating at a web slitting cut point;

said first blade having its axis of rotation transverse to said longitudinal axis of movement of the web and having its slitting edge rotational in a plane which is parallel to said longitudinal axis of movement of the web;

said blades having their slitting edges at less than 0.030 inch overlap;

said second blade having its slitting edge at a rake angle of 0–10 minutes relative to the slitting edge of said first blade at said cut point;

and said second blade slitting edge being at a toe-in angle of 5 to 30 minutes relative to said first blade slitting edge at said cut point.

2. A slitter according to claim 1, wherein said blades have surfaces facing generally toward the rotary cutting edge plane of the cooperating blade, and each of said blades having an opposite face provided with a relief bevel surface at an angle of from 15° to 30° to its rotary edge plane.

3. A slitter according to claim 1, wherein said blades have surfaces facing generally toward the rotary cutting edge plane of the cooperating blade, and each of said blades having an opposite face provided with a relief bevel surface at an angle of from 75° to 85° to its rotary edge plane.

4. A slitter according to claim 1, wherein said blades have substantially plane surfaces facing generally toward one another and the opposite surfaces of said blades including relief angles diverging from the respective blade cutting edges in a range of from 60° to 75° to a plane which extends through the cutting edge normal to the rotational plane of the edge.

5. A slitter according to claim 1, wherein said blades have substantially plane surfaces facing generally toward one another and the opposite surfaces of said blades including relief angles diverging from the respective blade cutting edges in a range of from 5° to 15° to a plane which extends through the cutting edge normal to the rotational plane of the edge.

6. A slitter according to claim 1, including means rotatably supporting said first blade and including web supporting structure corotational with said first blade.

7. A slitter according to claim 6, wherein said web supporting structure comprises drum surfaces at each opposite side of said first blade, and means spacing said first blade from each of said drum surfaces.

8. A slitter according to claim 1, wherein said blades have their slitting edges at substantially 0.015" overlap.

9. A slitter for high bulk traveling paper web material and adapted to be located between a web source and subsequent processing equipment comprising:

means for guiding the traveling web along a longitudinal axis of movement;

first and second rotary slitter blades having peripheral slitting edges cooperating at a web slitting cut point;

said first blade having its axis of rotation transverse to said longitudinal axis of movement of the web and having its slitting edge rotational in a plane which is parallel to said longitudinal axis of movement of the web;

said blades having their slitting edges at substantially 0.015 inch overlap;

and said second blade having its slitting edge at a rake angle of 0–10 minutes and a toe-in angle of 5 to 30 minutes relative to and cooperating with said first blade slitting edge at said cut point so that rubbing wear of the blades after the cut point in the overlap area is avoided and excellent slitting pressure is attained at the cut point but plowing is greatly minimized and climbing of the blades one upon the other is avoided as they rotate in the slitting process.

10. A slitter according to claim 9, wherein each of said blades has opposite faces one of which is in the plane of the rotary cutting edge of the blade and the other of which faces away from the cutting edge and has a relief bevel surface converging with the rotary edge at an angle of from 15° to 30° to the rotary edge plane where the blade is of the high angle type.

11. A slitter according to claim 9, wherein each of said blades has opposite faces one of which is in the plane of the rotary cutting edge of the blade and the other of which faces away from the cutting edge and has a relief bevel surface converging with the rotary edge at an angle of from 75° to 85° to the rotary edge plane where the blade is of the low angle type.

* * * * *